United States Patent [19]

Okutsu et al.

[11] Patent Number: 4,740,452

[45] Date of Patent: Apr. 26, 1988

[54] PROCESS FOR PREPARING NEGATIVE IMAGES

[75] Inventors: Eiichi Okutsu; Mitsunori Hirano, both of Kanagawa, Japan

[73] Assignee: Fuji Photo Film Co., Ltd., Kanagawa, Japan

[21] Appl. No.: 865,695

[22] Filed: May 22, 1986

[30] Foreign Application Priority Data

May 22, 1985 [JP] Japan ..... 60-109743

[51] Int. Cl.[4] ..... G03C 5/30

[52] U.S. Cl. ..... 430/439; 430/487; 430/490; 430/478; 430/482; 430/486; 430/441; 430/442; 430/265; 430/267; 430/949; 430/445; 430/446; 430/448; 430/268

[58] Field of Search ..... 430/488, 268, 264, 265, 430/267, 438, 487, 486, 490, 599, 949, 478, 482, 441, 442, 439, 445, 446, 448, 435

[56] References Cited

U.S. PATENT DOCUMENTS

| | | | |
|---|---|---|---|
| Re. 29,111 | 1/1977 | Masseth | 430/268 |
| 2,388,816 | 6/1942 | Bean | 430/488 |
| 4,224,401 | 9/1980 | Takeda et al. | 430/437 |
| 4,232,112 | 11/1980 | Kuse | 430/486 |
| 4,269,929 | 5/1981 | Nothnagle | 430/486 |
| 4,298,673 | 11/1981 | Kubotera et al. | 430/485 |

FOREIGN PATENT DOCUMENTS

| | | |
|---|---|---|
| 32456 | 7/1981 | European Pat. Off. . |
| 164120 | 12/1985 | European Pat. Off. . |
| 2077453 | 12/1981 | United Kingdom . |

*Primary Examiner*—Won H. Louie

*Attorney, Agent, or Firm*—Sughrue, Mion, Zinn, Macpeak, and Seas

[57] ABSTRACT

The present invention provides a process for preparing a negative image of high contrast comprising developing an exposed silver halide photographic material which is substantially a surface latent image-type material in the presence of a hydrazine derivative, wherein said material is processed with a water-soluble alkaline developer having a pH value of from 10.5 to 12.3 and at least comprising the following components (1) through (3):

(1) a dihydroxybenzene-type developing agent;

(2) 0.3 mole/liter (developer) or more of a sulfite preservative; and (3) from 0.01 to 0.30 mole/liter (developer) of a compound of formula (A)

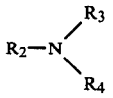

(A)

in which $R_2$ represents an alkyl group having from 3 to 6 carbon atoms; $R_3$ and $R_4$ each represents an alkyl or hydroxyalkyl group having from 1 to 10 carbon atoms.

The formed negative images are of high contrast and are almost free from silver stain. The sensitivity is high and the dot image quality is good.

17 Claims, No Drawings

PROCESS FOR PREPARING NEGATIVE IMAGES

FIELD OF THE INVENTION

The present invention relates to a method for contrasty development of a silver halide photographic material, and in particular, to a process for preparing a negative image of high contrast which is especially suitable to a photomechanical process for printing of graphic arts.

BACKGROUND OF THE INVENTION

In the field of graphic arts, an image formation system capable of giving a photographic characteristic of high contrast is required, enough to attain a good regeneration of a dot image of continuous gradation as well as a good regeneration of a line image.

A specific developer called a lith-developer has heretofore been used for the purpose. The lith-developer contains only hydroquinone as a developing agent, and uses a sulfite preservative in the form of an adduct of a sulfite with formaldehyde in order to keep extremely low concentration of the free sulfite ion in the developer, whereby the infectious developability is not deteriorated. Thus, the lith-developer is extremely easily oxidized with air and difficult to withstand a preservation of over three days, which is a serious defect.

Methods for obtaining a photographic characteristic of high contrast by the use of a stable developer are disclosed in U.S. Pat. Nos. 4,224,401, 4,168,977, 4,166,742, 4,311,781, 4,272,606, 4,211,857, and 4,243,739, where a hydrazine derivative is used. According to the methods, a photographic characteristic of high contrast and high sensitivity may be obtained, and moreover, addition of a sulfite of high concentration to a developer is possible. Accordingly, the stability of the developer against air-oxidation is markedly improved, as compared with the lith-developer.

In the methods using a hydrazine derivative, however, the pH value of the developer is kept higher than that of a conventional lith-developer, and therefore, the pH value of the developer is variable, resulting in a variation of the developed photographic characteristics. This is a troublesome problem.

U.S. Pat. No. 4,269,929 discloses, in order to solve said problem, to use an alkaline developer containing a dihydroxy-benzene developing agent and a 3-pyrazolidone developing agent, to which an amino compound is added so as to improve the activity of the developer; whereby the hydrazine derivative exerts effects of sensitization and producing high contrast image by the developer having a lower pH value.

It is impossible, however, to sufficiently lower the pH value of the developer enough to stop the variation of the pH value under the condition of a general preservation or use, even by the method.

In addition, the amino compounds added to the developer act as a solvent of a silver halide (refer to *The Theory of the Photographic Process,* 3rd Ed., p. 370, written by C. E. K. Mees, and *Photographic Processing Chemistry,* p. 43, written by L. F. A. Mason). Under the circumstances, the method for the development using a large amount of amino compounds as disclosed in the U.S. Patent has a problem of a so-called "silver stain". The "silver stain" is a defective phenomenon which occurs during development by a transfer of silver, which is depositioned or precipitated on the surface of a wall of the development tank or of a roller of a film conveyer from a silver halide dissolved in a developer, to a fresh film to be newly developed, wherein the developer is used in a development method using an automatic developing apparatus where a supplementary developer solution is fed into a development tank, in accordance with the area of the film to be developed and, the developer in the tank is used for a long period of time.

In order to overcome the defect of silver stain, such compound is necessarily to be used, that has an activity for high contrasty development but does not act as a solvent of silver halides. Whereas, no compounds have heretofore been known in this technical field, which may satisfy the requirement.

SUMMARY OF THE INVENTION

The object of the present invention is therefore to provide a process for preparing a negative image of high contrast preferably having a $\gamma$ value of 10 or more in the presence of a hydrazine derivative, to obtain a photographic film image with less silver stain.

Accordingly, the present invention provides a novel process for preparing a negative image of high contrast by developing an exposed silver halide photographic material which is a surface latent image-type material in the presence of a hydrazine derivative, characterized in that the material is processed with a water-soluble alkaline developer having a pH value of from 10.5 to 12.3 and at least comprising the following components (1) through (3):

(1) a dihydroxybenzene-type developing agent;

(2) 0.3 mole/liter (developer) or more of a sulfite preservative; and (3) 0.01 to 0.30 mole/liter (developer) of a compound of formula (A)

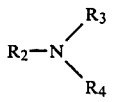

(A)

wherein $R_2$ represents an alkyl group having from 3 to 6 carbon atoms; $R_3$ and $R_4$ each represents an alkyl or hydroxyalkyl group having from 1 to 10 carbon atoms.

DETAILED DESCRIPTION OF THE INVENTION

The process for preparing photographic images of the present invention preferably uses a dihydroxybenzene-type developing agent as a main developing agent and a p-aminophenol-type developing agent or a 3-pyrazolidone-type developing agent as an auxiliary developing agent, and as the case may be, the auxiliary developing agent is optionally used in the process of the present invention.

Dihydroxybenzene-type developing agent used in the present invention is represented by the following formula (D)

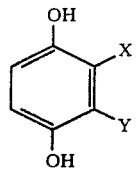

(D)

wherein X and Y each represents a hydrogen atom, a halogen atom or an alkyl group having from 1 to 5 carbon atoms.

Examples of dihydroxybenzene-type developing agents which may be used in the present invention include hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, etc.; and hydroquinone is especially preferred among them.

Examples of 1-phenyl-3-pyrazolidone or derivatives thereof which may be used as an auxiliary developing agent are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

Examples of p-aminophenyl-type auxiliary developing agents are N-methyl-p-aminophenol, p-aminophenol, N-(β-hydroxyethyl)-p-aminopheno, N-(4-hydroxyphenyl)glycine, 2-methyl-p-aminophenol, p-benzyl-aminophenol, etc.; and N-methyl-p-aminophenol is especially preferred among them.

The dihydroxybenzene-type developing agent is in general used preferably in an amount of from 0.05 mole to 0.8 mole, more preferably from 0.2 mole to 0.6 mole per liter of the developer. In case of a combination comprising dihydroxybenzenes and 1-phenyl-3-pyrazolidones or a p-aminophenols is used, the amount of the former to be used is preferably from 0.05 mol to 0.5 mole, and the amount of the latter to be used is preferably 0.06 mole or less, more preferably 0.03 mole or less, per liter of the developer.

Examples of sulfite preservatives to be used in the present invention are sodium sulfite, potassium sulfite, lithium sulfite, sodium bisulfite, potassium meta-bisulfite, formaldehyde-sodium bisulfite, etc. The amount of sulfite to be used is 0.3 mole/liter or more, more preferably 0.4 mole or more per liter of the developer. Excessive addition of the sulfite to a developer, however, causes to precipitate in the developer, resulting in staining of the developer solution, and therefore, the upper limit of the amount is preferably 1.2 mole/liter, more preferably 1.0 mole per liter of the developer.

$R_2$ in formula (A) to be used in the present invention represents an alkyl group having from 3 to 6 carbon atoms, which may be either linear or branched, and for example, represents an n-propyl group, an i-propyl group, an n-butyl group, a t-butyl group, an n-pentyl group, a t-pentyl group, an n-hexyl group, etc.

$R_3$ and $R_4$ in formula (A) each represents an alkyl or hydroxyalkyl group having from 1 to 10 carbon atoms, which may be either linear or branched, and for example, each represents a methyl group, an ethyl group, a n-propyl group, an i-propyl group, an n-butyl group, a t-butyl group, an n-pentyl group, a t-pentyl group, an n-hexyl group, an n-heptyl group, an n-octyl group, an n-nonyl group, an n-decyl group, a hydroxyethyl group, a 1-hydroxypropyl group, a 2-hydroxypropyl group, a 1,2-dihydroxypropyl group, a 1-hydroxybutyl group, etc.

In formula (A), at least one of $R_3$ and $R_4$ especially preferably represents a hydroxyalkyl group having from 2 to 4 carbon atoms.

Examples of amino compounds of formula (A) are n-butyldiethanolamine, n-propyldiethanolamine, 2-di-isopropylaminoethanol, N,N-di-n-butylethanolamine, 3-di-propylamino-1,2-propanediol, etc.

The amino compounds represented by formula (A), being different from any other amino compounds, have excellent characteristics in that these remarkably accelerate the high contrast of the formed images, even though these are used in a small amount and on the other hand, these have a weak action to silver halides as a solvent and these do not cause any silver stain in the developed photographic materials.

The amino compound of formula (A) is used in an amount of from 0.01 to 0.30 mole, most preferably from 0.01 to 0.2 mole per liter of a developer.

The amino compounds of formula (A) are relatively low soluble in a developer (water), and therefore, if the volume of a developer containing the amino compound is to be reduced by concentration than that on use for the convenience in storage or on transportation, the contained amino compound of formula (A) often deposits or precipitates in the developer. Whereas, in case a compound of the following formula (B) or (C) is used together with the present amino compound of formula (A), the crystallization or precipitation of the amino compound of formula (A) may be prevented even after the developer is concentrated. Therefore, the use of the compound of formula (B) or (C) is preferred in the process of the present invention.

$$R_5—SO_3M \quad (B)$$

$$R_6—COOM \quad (C)$$

wherein, M represents hydrogen atom or Na, K or $NH_4$; $R_5$ and $R_6$ each represents an alkyl group having 3 to 30 carbon atoms or alkylbenzene group having an alkyl moiety having from 3 to 30 carbon atoms or benzene group.

Examples of the compounds of formula (B) are sodium p-toluenesulfonate, sodium benzene-sulfonate, sodium 1-hexanesulfonate, etc. Examples of the compounds of formula (C) are sodium benzoate, sodium p-toluylate, potassium isobutyrate, sodium n-caproate, sodium n-caprrylate, sodium n-caprate, etc.

The amount of each of the compounds of formulae (B) and (C) to be used varies, depending upon the used amount of the amino compound of formula (A), and is in general 0.005 mole or more, preferably from 0.03 mole to 0.1 mole per liter of the developer. The amount suitably falls within the range of from 0.5 to 20 moles, per mole of the amino compound of formula (A).

The pH value of the developer to be used in the present invention is to be adjusted within the range of from 10.5 to 12.3. For the adjustment of the pH value of the developer to be used, an alkaline agent may be used, including a conventional water-soluble inorganic alkali metal salt (such as sodium hydroxide, sodium carbonate, potassium tert-phosphate, etc.). In addition, the above-described amino compounds of formula (A) may also be used for obtaining the desired pH value of the developer.

The developer of the present invention may further contain, in addition to the above-described components, a pH buffer such as boric acid, borax, sodium tert-phosphate, or potassium tert-phosphate; a development inhibitor such as potassium bromide or potassium iodide; an organic solvent such as ethyleneglycol, diethyleneglycol, triethyleneglycol, dimethylformamide, methylcellosolve, hexyleneglycol, ethanol, or methanol; an anti-fogging agent or a black pepper-inhibitor such as an indazole compound (e.g., 5-nitroindazole) or a benzotriazole compound (e.g., 5-methylbenzotriazole), etc. In case that 5-nitroindazole or the like compound is to be used, the compound is previously dissolved in a separate solution, apart from the main solution containing a dihydroxybenzene-type developing agent and a sulfite preservative, and the two solutions are blened and water is added thereto, at the time of the actual use of the developer, which is a general means. In the case, the 5-nitroindazole-containing solution is preferably made alkaline thereby to be colored in yellow, and thus, the colored solution may easily be handled in an actual photographic operation.

In addition, the developer of the present invention may further contain, if necessary, a toning agent, a surfactant, a water-softener, a hardener, etc.

As a fixing solution, any conventional ones may be used. As a fixing agent may be used a thiosulfate and a thiocyanate, and in addition, any other organic sulfur compounds which are known to be effective as a fixing agent may also be used. As an oxidizing agent may be used ethylenediamine-tetraacetate-iron (III) complex.

The temperature upon development treatment is selected in general from the range of from 18° to 50° C., but the temperature may optionally be lower than 18° C. or may optionally be higher than 50° C.

The process of the present invention is especially suitable for a rapid treatment using an automatic development apparatus. The automatic development apparatus may be any type of a roller conveyance system, a belt conveyance system, or other system. The treatment time may be short, totaling 2 minutes or less, especially 100 seconds or less, and among them, the time allotted for the development may be from 15 to 60 seconds. The developer of the present invention may sufficiently attain the effect even in such rapid development.

Hydrazine derivatives which may be used in the present invention are preferably compounds of formula (I)

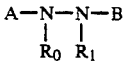

$$A-\underset{R_0}{N}-\underset{R_1}{N}-B \qquad (I)$$

wherein, A represents an aliphatic group or an aromatic group and may contain a ballast group or an adsorption accelerating group; B represents a formyl group, an acyl group, an alkyl- or aryl-sulfonyl group, an alkyl- or aryl-sulfinyl group, a carbamoyl group, a sulfamoyl group, an alkoxy- or aryloxy-carbonyl group, a sulfinamoyl group, an alkoxysulfonyl group, a thioacyl group, a thiocarbamoyl group, or a heterocyclic group; $R_0$ and $R_1$ both represent hydrogen atoms; or one of them represents a hydrogen atom, and the other represents a substituted or unsubstituted alkylsulfonyl group, a substituted or unsubstituted arylsulfonyl group, or a substituted or unsubstituted acyl group; as the case may be, B, $R_1$, and the nitrogen atoms bonded thereto may form a partial structure (—N=C<) of a hydrazone.

In formula (I), the aliphatic group for the symbol A preferably has from 1 to 30 carbon atoms, and is especially a linear, branched, or cyclic alkyl group having from 1 to 20 carbon atoms. The branched alkyl group may be ring-closed to form saturated hetero-cycle containing one or more hetero-atoms therein. In addition, the alkyl group may optionally have a substituent selected from an aryl group, an alkoxy group having from 1 to 20 carbon atoms, a sulfoxy group, a sulfonamide group having from 1 to 30 carbon atoms, and a carbonamido group having from 2 to 30 carbon atoms.

Examples of the aliphatic group of A are a t-butyl group, an n-octyl group, a t-octyl group, a cyclohexyl group, a pyrrolidyl group, an imidazolyl group, a tetrahydrofuryl group, and a morpholino group.

In formula (I), the aromatic group represented by A is a mono-cyclic or di-cyclic aryl group or an unsaturated heterocyclic residue. The unsaturated heterocyclic residue may be condensed with a mono-cyclic or di-cyclic aryl group to form a hetero-aryl group.

Examples of the aromatic group of A are a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc.; and benzene ring-containing groups are preferred among them.

The especially preferred group of A is an aryl group.

The aryl groups and unsaturated heterocyclic groups of A may have substituents. Typical substituents therefor are a linear, branched, or cyclic alkyl group (preferably having from 1 to 20 carbon atoms), an aralkyl group (preferably a mono-cyclic or di-cyclic group having from 1 to 3 carbon atoms in the alkyl moiety), an alkoxy group (preferably having from 1 to 20 carbon atoms), a substituted amino group (preferably sustituted by an alkyl group having from 1 to 20 carbon atoms), an acylamino group (preferably having from 2 to 30 carbon atoms), a sulfonamide group (preferably having from 1 to 30 carbon atoms), a ureido group (preferably having from 1 to 30 carbon atoms), etc.

The substituent A in formula (I) may contain a ballast group which is conventionally used in passive photographic additives such as a coupler. The ballast group is a group having 8 or more carbon atoms, which is relatively inactive in a photographic characteristic, and, for example, may be selected from an alkyl group, an alkoxy group, a phenyl group, an alkylphenyl group, a phenoxy group, and an alkylphenoxy group, as is described in U.S. Pat. No. 4,385,108.

The substituent A in formula (I) may contain an adsorption-accelerating group which may accelerate the adsorbability of the compound to the surface of silver halide particles. Examples of the adsorption-accelerating groups are a thiourea group, a heterocyclic thioamido group, a mercapto-heterocyclic group, or a triazole group, as described in U.S. Pat. Nos. 4,385,108 and 4,459,347, Japanese Patent Application (OPI) Nos. 195233/84, 200231/84, 201045/84, 201046/84, 201047/84, 201048/84, 201049/84 and Japanese Patent Application Nos. 36788/84, 11459/85 and 19739/85. (The term "OPI" as used herein refers to a "published unexamined Japanese patent application".)

The substituent B in formula (I) concretely represents a formyl group, an acyl group (such as acetyl group, propionyl group, trifluoroacetyl group, chloroacetyl group, benzoyl group, 4-chlorobenzoyl group, pyruvoyl group, methoxalyl group, methyloxamoyl group), an alkylsulfonyl group (such as methanesulfonyl group, 2-chloroethanesulfonyl group), an arylsulfonyl group (such as benzenesulfonyl group), an alkylsulfinyl group (such as methanesulfinyl group), an arylsulfinyl group (such as benzenesulfinyl group), a carbamoyl group (such as methylcarbamoyl group and phenylcarbamoyl group), a sulfamoyl group (such as dimethylsulfamoyl group), an alkoxycarbonyl group (such as methoxycarbonyl group and methoxyethoxycarbonyl group), an aryloxycarbonyl group (such as phenoxycarbonyl group), a sulfinamoyl moyl group (such as methylsulfinamoyl group), an alkoxysulfonyl group (such as methoxysulfonyl group, ethoxysulfonyl group), a thioacyl group (such as methylthiocarbonyl group), a thiocarbamoyl group (such as emthylthiocarbamoyl group) or a heterocyclic group (such as pyridine ring).

The substituent B in formula (I) may form, together with $R_1$ and the nitrogen atoms to which these substituents are bonded, a partial structure of hydrazone

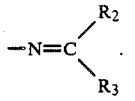

In the formula, $R_2$ represents an alkyl group, an aryl group or a heterocyclic group; and $R_3$ represents a hydrogen atom, an alkyl group, an aryl group, or a heterocyclic group.

$R_0$ and $R_1$ in formula (I) each represents a hydrogen atom, an alkylsulfonyl group, or arylsulfonyl group having 20 or less carbon atoms (preferably a phenylsulfonyl group or a substituted phenylsulfonyl group as having a Hammett's substitution constant of −0.5 or more in total) or an acryl group having 20 or less carbon atoms (preferably a benzoyl group, a substituted benzoyl group as having a Hammett's substitution constant of −0.5 or more in total, or a linear, branched, or cyclic unsubstituted or substituted aliphatic acyl group, examples of the substituents being a halogen atom, an ether group, a sulfonamido group, a carbonamido group, a hydroxyl group, a carboxyl group, and sulfonic acid group).

$R_0$ and $R_1$ are most preferably hydrogen atoms.

Illustrative examples of hydrazine derivatives which may be used in the present invention are given below, which, however, do not whatsoever restrict the scope of the present invention.

I-1

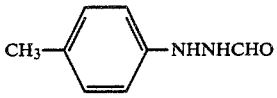

I-2

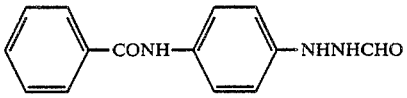

I-3

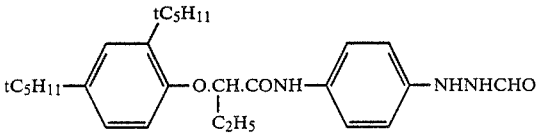

I-4

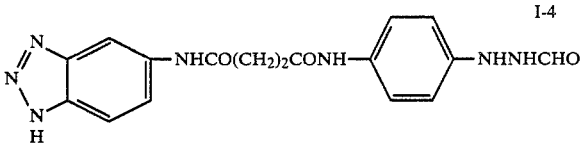

I-5

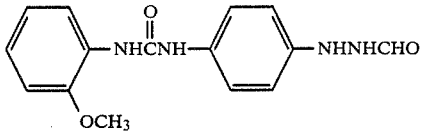

I-6

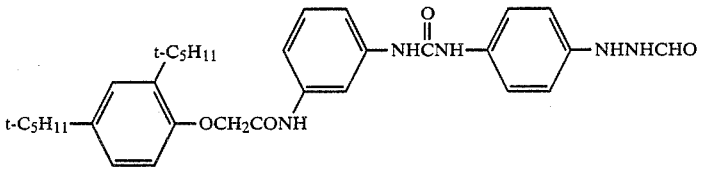

I-7

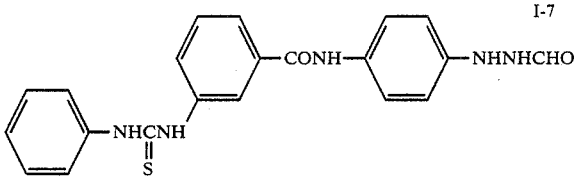

I-8

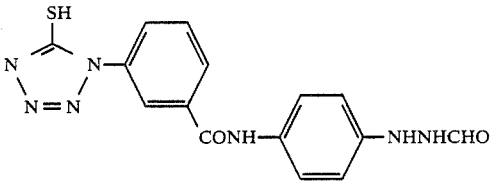

I-9

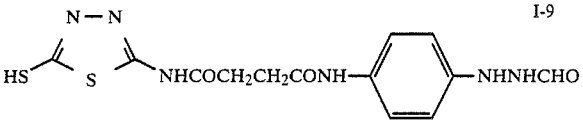

I-10

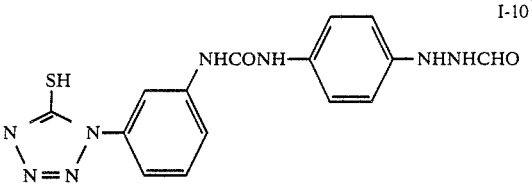

-continued

I-11

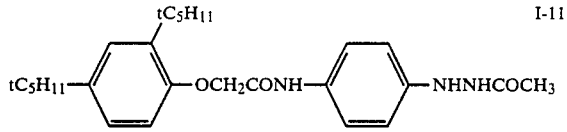

I-12

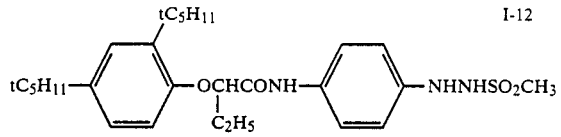

I-13

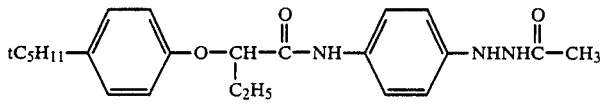

I-14

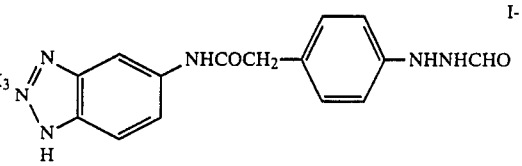

I-15

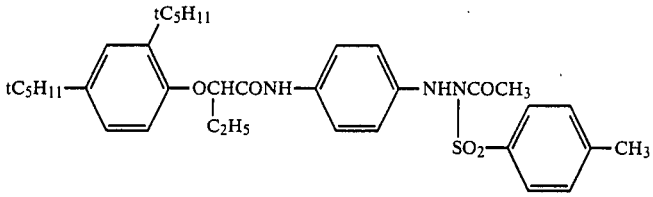

I-16

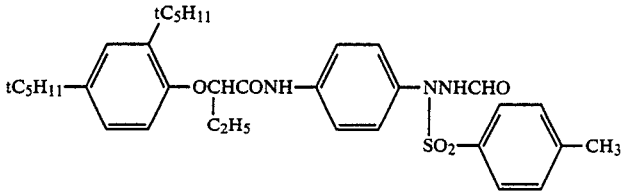

I-17

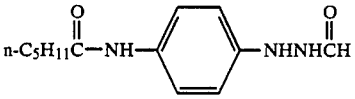

I-18

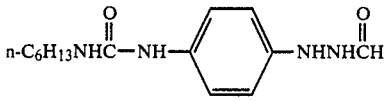

I-19

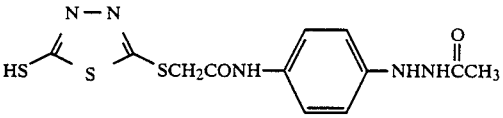

I-20

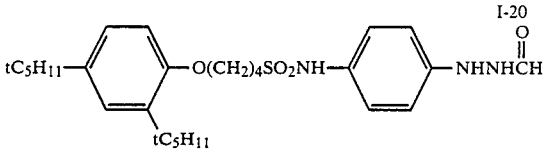

I-21

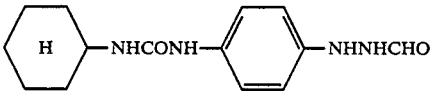

For the incorporation of the hydrazine derivative into a photographic material in the present invention, it is preferred that the derivative is added to a silver halide emulsion layer of the photographic material, or otherwise, the derivative may be incorporated into other non-lightsensitive hydrophilic colloid layers (such as protective layer, intermediate layer, filter layer, anti-halation layer, etc.). In practice, when the compound to be added is soluble in water, this may be added to a hydrophilic colloidal solution in the form of an aqueous solution; or on the contrary, when the compound to be added is hardly soluble in water, the compound may be added thereto in the form of a solution dissolved in an organic solvent which is compatible with water, such as an alcohol, an ester, a ketone, etc. In case of that the hydrazine derivative is to be added to a silver halide emulsion layer, the addition may be carried out in any desired stage from the beginning of chemical ripening to before coating, and it is preferred to add the compound during the period from after the finish of the chemical ripening to before the coating. In particular, it is most preferred to add the compound to a coating solution just ready for coating.

The amount of the hydrazine derivative to be contained in the photographic material of the present invention is preferably determined to be an optimum content, depending upon the particle size of the silver halide emulsion in the photographic material, the halogen composition in the emulsion, the method of chemical sensitization for the material and the degree thereof and the relation between the layer containing the hydrazine derivative and the silver halide emulsion layer, as well as upon the kind of the anti-fogging compound contained in the photographic material; and the test method for the selection is well known by those skilled in the art. In general, the amount of said compound of formula (I) is preferably within the range of from $10^{-6}$ mole to $1\times10^{-1}$ mole, especially from $10^{-5}$ mole to $4\times10^{-2}$ mole, per mole of the used silver halide.

The hydrazine derivative may be used in the present invention, as being incorporated in a developer solution. In this case, the amount of the hydrazine derivative to be incorporated is preferably from 5 mg to 5 g, especially preferably from 10 mg to 1 g, per liter of the developer.

Next, silver halide-photographic materials, to which the method for image-formation according to the present invention is to be applied, will be explained in greater detail in the following description.

The halogen composition in the silver halide emulsion which may be used in the present invention is not specifically limitative, and may be any composition selected from silver chloride, silver bromochloride, silver bromoiodide, silver bromide, and silver chlorobromoiodide. It is preferred that the content of silver iodide in the silver halide compositions is 5 mole% or less, especially 3 mole% or less.

The particle size distribution of the silver halide particles in the photographic emulsion to be used in the present invention may be relatively broad, but the particle size distribution is preferably narrow, and in particular, it is especially preferred that 90% of the total silver halide particles, the percentage being relative to the weight or to the number of the particles, may have a particle size falling within the range of an average particle size of ±40% (in general, this kind of emulsion is called a monodisperse-emulsion).

The silver halide particles to be used in the present invention are preferably fine particles (for example, 0.7 μm or less), and the particle size thereof is especially preferred to be 0.4 μm or less.

The silver halide particles to be contained in the photographic emulsion may have a regular crystalline form such as a cubic form or an octahedral form, or alternatively may have an irregular crystalline form such as a spherical form or a plate-like form, or otherwise may have a composite-crystal form comprising a mixture of regular and irregular crystalline forms.

The silver halide particles may comprise uniform phase in an inner phase and an outer phase or may comprise different phases therebetween.

A mixture of two or more different silver halide emulsions, which have been prepared separately and individually, may be used in the present invention.

In the silver halide emulsion to be used in the present invention, a cadmium salt, a sulfite, a lead salt, a thallium salt, an iridium salt, or a complex salt thereof, a rhodium salt, or a complex salt thereof, etc. may coexist, during the formation of silver halide particles or during the step of physical ripening thereof.

As the silver halide emulsion may be used a so-called primitive emulsion, which is not chemical-sensitized, but otherwise, a chemical-sensitized one may also be used. For the chemical sensitization may be utilized various methods as described in *Die Grundlagen der Photographischen Prozesse mit Silber-halogeniden,* written by H. Frieser and published by Akademische Verlagsgesellschaft (1968).

As described in the literature, chemical sensitization may be carried out, for example, by a sulfur sensitization method where a sulfur-containing compound capable of reacting with an active gelatin and silver (such as thiosulfates, thioureas, mercapto compounds, rhodanines, etc.) is used; a reductive sensitization method where a reducing substance (such as stannous salts, amines, hydrazine derivatives, formamidine-sulfinic acids, silane compounds, etc.) is used; or a noble metal sensitization method where a noble metal compound (such as gold compounds as well as complex salts of VIII-group metals (of Periodic Table) including platinum, iridium, palladium, etc.) is used. The sensitization method may be carried out singly or in the form of a combination of two or more of the means.

Gelatin is preferred as a binder or a protective colloid which may be used in an emulsion layer or in an intermediate layer of the photographic materials of the present invention, and other hydrophilic colloids may also be used therefor.

For example, the following substances may be used: Gelatin derivatives, graft-polymers of gelatin with other high molecular compounds, proteins such as albumin, casein, etc.; cellulose derivatives such as hydroxyethyl-cellulose, carboxymethyl-cellulose, cellulose-sulfates, etc.; saccharide derivatives such as sodium alginate, starch derivatives, etc.; and other various kinds of synthetic hydrophilic high molecular substances of mono- or co-polymers such as polyvinyl alcohol, partially acetallized-polyvinyl alcohol, poly-N-vinyl-pyrrolidone, polyacrylic acid, polymethacrylic acid, polyacrylamide, polyvinylimidazole, polyvinylpyrazole, etc.

As the gelatin substance may be used a lime-processed gelatin and an acid-processed gelatin, as well as an enzyme-processed gelatin as described in *Bull. Soc. Sci. Phot. Japan,* No. 16, page 30 (1966). In addition, hydrolyzed products or enzyme-decomposed products of gelatin may also be used therefor.

The photographic emulsion to be used in the present invention may be spectrally sensitized by the use of methine dyes or the like. Dyes which may be used for the purpose of spectral-sensitization include cyanine dyes, merocyanine dyes, complex cyanine dyes, complex merocyanine dyes, holopolar cyanine dyes, hemicyanine dyes, styryl dyes, and hemioxonole dyes. Especially effective dyes are those belonging to cyanine dyes, merocyanine dyes, and complex merocyanine dyes. These dyes may be used in the form of a combination of plural dyes thereof, so as to attain a super-sensitization effect.

Other dyes which per se do not have any spectral-sensitization activity or some other substances which do not substantially absorb any visible rays but have a super-sensitization activity may be incorporated in the emulsion, together with the sensitizing dyes. For instance, nitrogen-containing heterocyclic ring-substituted aminostilbene compounds (for example, those as described in U.S. Pat. Nos. 2,933,390 and 3,635,721), aromatic organic acid/formaldehyde condensation products (for example, those as described in U.S. Pat. No. 3,743,510), cadmium salts, azaindene compounds, etc. may be incorporated in the emulsion. In particular, the combination as described in U.S. Pat. Nos. 3,615,613, 3,615,641, 3,617,295, 3,635,721 are preferred.

Other various compounds may further be incorporated in the photographic emulsion to be used in the present invention, in order to prevent the occurrence of fog or to stabilize the photographic characteristics during the manufacture or preservation of photographic materials or during the photographic processing thereof. For instance, various compounds which are known as an anti-fogging agent or a stabilizer may be added to the present photographic emulsion, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds such as oxazoline-thione; azaindenes such as triazaindenes, tetrazaindenes (especially, 4-hydroxy-substituted-(1,3,3a,7)-tetrazaindenes), pentazaindenes, etc.; benzenethiosulfonic acids, benzenesulfinic acids, benzenesulfonic acid amides, etc.

Among them, benzotriazoles (e.g., 5-methylbenzotriazole) and nitroindazoles (e.g., 5-nitroindazole) are especially preferred. These compounds may be added to a treating solution.

The photographic materials of the present invention may contain an inorganic or organic hardening agent in the photographic emulsion layers or in any other hydrophilic colloid layers. For example, chromium salts (such as chromium alum, chromium acetate, etc.), aldehydes (such as formaldehyde, glyoxal, glutaraldehyde, etc.), N-methylol compounds (such as dimethylol-urea, methylol-dimethylhydantoin, etc.), dioxane derivatives (such as 2,3-dihydroxydioxane, etc.), active vinyl compounds (such as 1,3,5-triacryloyl-hexahydro-s-triazine, 1,3-vinylsulfonyl-2-propanol, etc.), active halogen-compounds (such as 2,4-dichloro-6-hydroxy-s-triazine, etc.) and mucohalogenic acids (such as mucochloric acid, mucophenoxychloric acid, etc.) may be used singly or in the form of a combined mixture of said compounds.

The photographic materials of the present invention may further contain various kinds of surfactants, in the photographic emulsion layers or in any other hydrophilic colloid layer, for various purposes of coating assistance, static charge prevention, slide property improvement, dispersive emulsification, anti-blocking and photographic characteristic improvement (for example, development acceleration, high contrast achievement, sensitization).

For instance, the surfactants include non-ionic surfactants such as saponins (steroid-type), alkyleneoxide derivatives (e.g., polyethylene-glycol, polyethylene-glycol/polypropylene-glycol condensation product, polyethylene-glycol-alkylethers, or polyethylene-glycol-alkylarylethers, polyethylene-glycol-esters, polyethylene-glycol-sorbitanesters, polyalkylene-glycol-alkyl-amines or -amides, silicone-polyethyleneoxide adducts, etc.), glycidol derivatives (e.g., alkenylsuccinic acid-polyglycerides, alkylphenolpolyglycerides, etc.), fatty acid esters of polyhydric alcohols and alkylesters of saccharides; anionic surfactants containing an acidic group such as carboxyl, sulfo, phospho, sulfuric ester, or phosphoric ester group, for example, alkylcarboxylic acid salts, alkylsulfonic acid salts, alkylbenzensulfonic acid salts, alkylnaphthalenesulfonic acid salts, alkyl sulfates, alkyl phosphates, N-acyl-N-alkyltaurines, sulfo-succinates, sulfo-alkylpolyoxyethylene-alkylphenylethers, polyoxyethylene-alkyl phosphates, etc.; ampholytic surfactants such as amino acids, aminoalkylsulfonic acids, aminoalkyl sulfates, or phosphates, alkylbetaines, amine-oxides, etc.; and cationic surfactants such as alkylamine salts, aliphatic, or aromatic quaternary ammonium salts, heterocyclic quaternary ammonium salts (e.g., pyridinium or imidazolium salts), aliphatic or heterocyclic ring-containing phosphonium salts, sulphonium salts, etc.

Especially preferred surfactants in the present invention are polyalkyleneoxides having a molecular weight of 600 or more, which are described in Japanese Patent Publication No. 9412/83.

The photographic materials of the present invention may further contain a dispersion of a water-insoluble or hardly soluble synthetic polymer in the photographic emulsion layers or in any other hydrophilic colloid layers, for the purpose of improvement of the dimensional stability of the photographic materials. For example, polymers or copolymers of alkyl (meth)acrylates, alkoxyalkyl (meth)acrylates, glycidyl (meth)acrylates, (meth)acrylamides, vinyl esters (e.g., vinyl acetate), acrylonitriles, olefins, styrenes, etc.; as well as those formed by the combination of said monomers and acrylic acids, methacrylic acids, $\alpha,\beta$-unsaturated carboxylic acids, hydroxyalkyl (meth)acrylates, sulfoalkyl (meth)acrylates, styrene-sulfonic acids, etc. may be used therefor.

The present invention will be explained in greater detail by reference to the following examples, which, however, are not intended to be interpreted as limiting the scope of the present invention.

EXAMPLE 1

To a silver bromoiodide emulsion containing 2.5 mole% of iodide and having a particle shape of 0.3 $\mu$m cubic form, were added 230 mg/l mole (silver) of anhydro-5,5-dichloro-9-ethyl-3,3'-bis(3-sulfopropyl)oxacarbocyaninehydroxide.sodium salt (sensitizer dye), 1,3 g/l mole (silver) ($2.9\times10^{-3}$ mole/l mole (silver)) of the above-described hydrazine derivative (Compound No. I-3) and 300 mg/l mole (silver) of polyethylene glycol (molecular weight: about 1000); and then, a dispersion comprising 5-methylbenztriazole, 4-hydroxy-6-methyl-1,3,3a,7-tetrazaindene and polyethyl acrylate, and 2-hydroxy-1,3,5-triazine.sodium salt were further added thereto.

Thus prepared coating solution was coated on a polyethylene terephthalate film support to obtain a film A, where the coated silver amount was 4.0 g/m$^2$ and the coated gelatin amount was 2.5 g/m$^2$.

In comparison, another film B was prepared in the same manner as the film A, with the exception that the Compound No. I-3 was not added.

These films were sensitometrically exposed using an exposure wedge and a 150 line-magenta contact screen, and then the films were developed using various kinds of developers each comprising a different composition as shown below, at 38° C. for 30 seconds, and thereafter fixed, washed with water, and dried (this treatment was carried out by the use of an automatic development machine FG 660F manufactured by Fuji Photo Film Co., Ltd.).

The following Table 2 shows the state in the preparation of a concentrated developer solution (the volume of which is half of a developer solution to be actually used) and the photographic characteristic of the developer solution when this was used, as being diluted with water, in the form of a fresh developer solution. Relative to the Developers C, F, H, J, K, L, M, N, P, Q, and R, 100 ml of each of developers was supplemented with every development of a wholly exposed film having a half area of a complete large size (50.8 cm$\times$61.0 cm), and thus, 200 sheets of the exposed films were developed every day for continuous five days by running-treatment system, and the photographic characteristics attained by the continuous development and the degree of the occurred silver stain are given in Table 2.

In Table 2, the sensitivity in each test sample is a relative one, where a reciprocal of an exposure amount required for obtaining a density of 1.5 when the film A was treated with Developer C is set as an index of 100.

$\overline{G}$ designates a value of tan $\theta$ based on an angle composed by a straight line joining two points on a characteristic curve which correspond to densities 0.3 and 3.0. The dot image quality is shown using visual grades of 1 through 5, in which "5" is the best, and "1" is the worst. The grades "5" and "4" mean practically useful qualities as a dot image negative plate in photo-mechanical process; the grade "3" means a coarse quality and is barely practical; and the grades "2" and "1" means impractical ones.

The silver stain is shown also using numerical grades 1 through 5, in which "5" means occurrence of no silver stain on the surface of a film having an area of 9.0 cm×25.0 cm; and "1" means extreme occurrence of silver stain on the whole surface of the film. The grade "4" means a slight occurrence of silver stain at only a part of the film surface, and this is allowable in a practical use. The grade "3" and the lower grade mean impractical ones.

Developer L (comparative sample):

Same as the Developer C with the exception that 20.0 g of 3-diethylamino-1-propanol was substituted by 0.153 mole/liter of 3-diethylamino-1,2-propanediol.

Developer M (comparative sample):

Same as the Developer C with the exception that 20.0 g of 3-diethylamino-1-propanol was substituted by 0.153 mole/liter of 2-diethylamino-1-ethanol.

Developer N (comparative sample):

Same as the Developer C with the exception that 20.0 g of diethylamino-1-propanol was substituted by 0.153 mole/liter of triethylamine.

Developer P (comparative sample):

Same as the Developer C with the exception that 20.0 g of 3-diethylamino-1-propanol was substituted by 0.153 mole/liter of 3-dimethylamino-1-propanol.

Developer Q (comparative sample):

TABLE 1

| Developer | C (comparative sample) | D (comparative sample) | E (present sample) | F (present sample) | G (comparative sample) | H (present sample) |
|---|---|---|---|---|---|---|
| Tetra-sodium ethylenediamine-tetraacetate | 1.0 g | 1.0 g | 1.0 g | 1.0 g | 1.0 g | 1.0 g |
| Sodium hydroxide | 9.0 g | 9.0 g | 9.0 g | 9.0 g | 6.0 g | 9.0 g |
| Potassium tert-phosphate | 74.0 g | 74.0 g | 74.0 g | 74.0 g | 74.0 g | 74.0 g |
| Potassium sulfite | 90.0 g | 90.0 g | 90.0 g | 90.0 g | 90.0 g | 40.0 g |
| 5-Methylbenzotriazole | 0.5 g | 0.5 g | 0.5 g | 0.5 g | 0.5 g | 0.5 g |
| Sodium bromide | 3.0 g | 3.0 g | 3.0 g | 3.0 g | 3.0 g | 3.0 g |
| p-Aminophenol.$\frac{1}{2}H_2SO_4$ | 1.0 g | 1.0 g | 1.0 g | 1.0 g | 35.0 g | 1.0 g |
| Hydroquinone | 35.0 g | 35.0 g | 35.0 g | 35.0 g | — | 35.0 g |
| 3-Diethylamino-1-propanol | 20.0 g | 5.0 g | — | — | — | — |
| N—Butyl-diethanol-amine | — | — | 5.0 g | 5.0 g | 5.0 g | 5.0 g |
| Sodium p-toluenesulfonate | — | — | — | 10.0 g | 10.0 g | 10.0 g |
| pH | 11.6 | 11.6 | 11.6 | 11.6 | 11.6 | 11.6 |
| All components were dissolved in water to form a concentrated solution having a volume of 500 ml in total. | dissolved | dissolved | not dissolved | dissolved | not dissolved | dissolved |
| All components were dissolved in water to form a developer solution ready for use, having a volume of one liter in total. | dissolved | dissolved | dissolved | dissolved | dissolved | dissolved |

Developer J (comparative sample):

Same as the Developer C with the exception that 20.0 g (0.153 mole/liter) of 3-diethylamino-1-propanol in the Developer C was substituted by 0.153 mole/liter of triethanolamine.

Developer K (comparative sample):

Same as the Developer C with the exception that 20.0 g of 3-diethylamino-1-propanol was substituted by 0.153 mole/liter of trimethylamine.

Same as the Developer C with the exception that 20.0 g of 3-diethylamino-1-propanol was substituted by 0.153 mole/liter of 2-dimethylaminoethanol.

Developer R (comparative sample):

Same as the Developer C with the exception that 20.0 g of 3-diethylamino-1-propanol was substituted by 0.153 mole/liter of 1-dimethylamino-2-propanol.

TABLE 2

| Sample No. | Used Film | Used Developer | State in Preparation of Concentration Developer Solution | Photographic Characteristics of Fresh Developer Solution: Sensitivity | $\bar{G}$ | Dot Image Quality | Photographic Characteristics of Fatigued Developer Solution after used for Development of 1000 Films by Running-Development for Continuous 5 Days: Sensitivity | $\bar{G}$ | Dot Image Quality | Silver Stain |
|---|---|---|---|---|---|---|---|---|---|---|
| 1 | A | C | dissolved | 100 | 15 | 5.0 | 100 | 15 | 5.0 | 3.0 |
| 2 | A | D | " | 50 | 5 | 2.0 | 50 | 5 | 2.0 | 4–5 |
| 3 | A | E | not dissolved | 100 | 15 | 5.0 | 100 | 15 | 5.0 | 5.0 |
| 4 | A | F | dissolved | 100 | 15 | 5.0 | 100 | 15 | 5.0 | 5.0 |
| 5 | A | G | not dissolved | 20 | 3 | 1.0 | — | — | — | — |
| 6 | A | H | dissolved | 100 | 15 | 5.0 | 70 | 8 | 3.0 | 5.0 |
| 7 | B | F | " | 20 | 3 | 1.0 | — | — | — | — |
| 8 | A | J | " | 50 | 5 | 2.0 | 50 | 5 | 2.0 | 3.0 |
| 9 | A | K | " | 100 | 15 | 5.0 | 100 | 15 | 5.0 | 2.0 |
| 10 | A | L | " | 75 | 10 | 3–4 | 75 | 10 | 3–4 | 3.0 |
| 11 | A | M | " | 100 | 15 | 5.0 | 100 | 15 | 5.0 | 3.0 |
| 12 | A | N | " | 100 | 15 | 5.0 | 100 | 15 | 5.0 | 2.0 |
| 13 | A | P | " | 85 | 12 | 4.0 | 85 | 12 | 4.0 | 3.0 |
| 14 | A | Q | " | 75 | 10 | 3–4 | 75 | 10 | 3–4 | 3.0 |
| 15 | A | R | " | 85 | 12 | 4.0 | 85 | 12 | 4.0 | 3.0 |

The results of the above Table 2 prove the following facts: When an amino compound which falls outside the scope of the formula (A) of the present invention is used, as in the sample No. (1), the silver stain is remarkable although the sensitivity, the value of $\overline{G}$, the dot image quality and the fatigue stability for 5 day-running development are good. In the sample No. (2), said amino compound is used only in a smaller amount so as to prevent the occurrence of the silver stain; however, the sensitivity is low, $\overline{G}$ is small and the dot image quality is bad, in the result.

On the other hand, when no dihydroxybenzene developing agent is used, as in the sample No. (5), the sensitivity is low, the value of $\overline{G}$ is small and the dot image quality is bad. When the concentration of the used sulfite is small, as in the sample No (6), the fatigue stability is bad. In case of the sample No. (7) where a film containing no hydrazine compound is developed, the sensitivity is low, the value of $\overline{G}$ is small and the dot image quality is bad. When an amino compound which falls outside the scope of the formula (A) of the present invention is used, as in the sample Nos. (8), (9), (10), (11), (12), (13), (14) and (15), the silver stain is remarkable in every case.

The sample No. (3) uses an amino compound of formula (A) of the present invention, and the sensitivity, the value of $\overline{G}$, the dot image quality and the fatigue stability for 5 day-running development are good, and the silver stain is little. The sample No. (4) has high value of $\overline{G}$, good dot image quality, good fatigue stability for 5 day-running development and high sensitivity, and this is almost free from silver stain. In addition, the concentrated solution of this sample No. (4) may be kept in a dissolved state, as this sample contains a compound of formula (B). Therefore, this sample No. (4) is especially advantageous, since the transportation of the developer solution is easy and the cost therefor may be reduced.

While the invention has been described in detail and with reference to specific embodiments thereof, it will be apparent to one skilled in the art that various changes and modifications can be made therein without departing from the spirit and scope thereof.

What is claimed is:

1. A process for preparing a negative image of high contrast comprising developing an exposed silver halide photographic material, in the presence of a hydrazine derivative, wherein the material is processed with a water-soluble alkaline developer having a pH value of from 10.5 to 12.3 and at least comprising the following components (1) through (3):

(1) a dihydroxybenzene-type developing agent;

(2) 0.3 mole/liter (developer) or more of a sulfite preservative; and (3) from 0.01 to 0.30 mole/liter (developer) of a compound of formula (A)

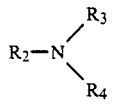

(A)

in which $R_2$ represents an alkyl group having from 3 to 6 carbon atoms; $R_3$ and $R_4$ each represents an alkyl or hydroxyalkyl group having from 1 to 10 carbon atoms.

2. The process for preparing a negative image of high contrast as claimed in claim 1, wherein at least one of $R_3$ and $R_4$ in the formula (A) represents a hydroxyalkyl group having from 2 to 4 carbon atoms.

3. The process for preparing a negative image of high contrast as claimed in claim 1, wherein the compound of formula (A) is selected from n-butyldiethanolamine, n-propyldiethanolamine, 2-di-isopropylaminoethanol, N,N-di-n-butylethanolamine and 3-di-propylamino-1,2-propane-diol.

4. The process for preparing a negative image of high contrast as claimed in claim 1, wherein a compound of the following formula (B) or (C) is used together with the compound of formula (A)

$$R_5—SO_3M \quad (B)$$

$$R_6—COOM \quad (C)$$

wherein M represents a hydrogen atom or Na, K or $NH_4$; $R_5$ and $R_6$ each represents an alkyl group or an alkylbenzene group having 3 or more carbon atoms or a benzene group.

5. The process for preparing a negative image of high contrast as claimed in claim 4, wherein the compound of formula (B) is selected from sodium p-toluenesulfonate, sodium benzenesulfonate and sodium 1-hexane-sulfonate.

6. The process for preparing a negative image of high contrast as claimed in claim 4, wherein the compound of formula (C) is selected from sodium benzoate, sodium p-toluene, potassium isobutyrate, sodium n-caproate, sodium n-caprylate and sodium n-caprate.

7. The process for preparing a negative image of high contrast as claimed in claim 1, wherein the compound of formula (A) is used in an amount of from 0.01 to 0.30 mole per liter of developer.

8. The process for preparing a negative image of high contrast as claimed in claim 1, wherein the compound of formula (A) is used in an amount of from 0.01 to 0.20 mole per liter of the developer.

9. The process for preparing a negative image of high contrast as claimed in claim 4, wherein the amount of the compound of formula (B) or (C) to be added to a developer is 0.005 mole/liter (developer) or more.

10. The process for preparing a negative image of high contrast as claimed in claim 9, wherein the amount of the compound of formula (B) or (C) to be added to a developer is from 0.03 to 0.1 mole per mole of the amino compound of formula (A).

11. The process for preparing a negative image of high contrast as claimed in claim 1, wherein said dihydroxybenzene-type developing agent is represented by the following formula (D)

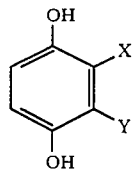

(D)

wherein X and Y each represents a hydrogen atom, a halogen atom or an alkyl group having from 1 to 5 carbon atoms.

12. The process for preparing a negative image of high contrast as claimed in claim 11, wherein said dihydroxybenzene-type developing agent is selected from hydroquinone, chlorohydroquinone, bromohydroquinone, isopropylhydroquinone, methylhydroquinone, 2,3-dichlorohydroquinone, 2,3-dibromohydroquinone and 2,5-dimethylhydroquinone.

13. The process for preparing a negative image of high contrast as claimed in claim 1, wherein said dihydroxybenzene-type developing agent is used together with an auxiliary developing agent selected from p-aminophenol-type developing agents and 3-pyrazolidone-type developing agents.

14. The process for preparing a negative image of high contrast as claimed in claim 1, wherein said sulfite preservative is selected from sodium sulfite, potassium sulfite, lithium sulfite, sodium bisulfite, potassium metabisulfite and formaldehyde-sodium bisulfite.

15. The process for preparing a negative image of high contrast as claimed in claim 1, wherein said hydrazine derivative is selected from compounds of a formula (I)

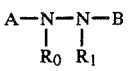

(I)

in which A represents an aliphatic group or an aromatic group which contain or does not contain a ballast group or a adsorption-accelerating group; B represents a formyl group, an acyl group, an alkyl- or aryl-sulfonyl group, an alkyl- or arylsulfinyl group, a carbamoyl group, a sulfamoyl group, an alkoxy- or aryloxycarbonyl group, a sulfinamoyl group, an alkoxysulfonyl group, a thioacyl group, a thiocarbamoyl group or a heterocyclic group; $R_0$ and $R_1$ both represent hydrogen atom, or one of them represents a hydrogen atom, and the other represents a substituted or unsubstituted alkylsulfonyl group, a substituted or unsubstituted arylsulfonyl group or a substituted or unsubstituted acyl group; as the case may be, B, $R_1$ and the nitrogen atoms bonded thereto may form a partial structure (—N=C<) of a hydrazone.

16. The process for preparing a negative image of high contrast as claimed in claim 1, wherein the hydrazine derivative is used in an amount of from $10^{-6}$ mole to $1\times10^{-1}$ mole per mole of silver halide.

17. The process for preparing a negative image of high contrast as claimed in claim 1, wherein the hydrazine derivative is used in an amount of from 5 mg to 5 g per liter of the developer.

* * * * *